US011761414B2

(12) United States Patent
Dirumdam et al.

(10) Patent No.: US 11,761,414 B2
(45) Date of Patent: Sep. 19, 2023

(54) CONTACTING DEVICE OF A VOLTAGE TRANSMISSION DEVICE OF AN IGNITION DEVICE OF A LARGE ENGINE, SPARK-PLUG, IGNITION DEVICE AND LARGE ENGINE

(71) Applicant: MAN Energy Solutions SE, Augsburg (DE)

(72) Inventors: Björn Dirumdam, Ellgau (DE); Christian Hummel, Oberdolling (DE); Matthias Birner, Langweid am Lech (DE)

(73) Assignee: MAN ENERGY SOLUTIONS SE, Augsburg (DE)

( * ) Notice: Subject to any disclaimer, the term of this patent is extended or adjusted under 35 U.S.C. 154(b) by 0 days.

(21) Appl. No.: 17/313,132

(22) Filed: May 6, 2021

(65) Prior Publication Data

US 2021/0348587 A1 Nov. 11, 2021

(30) Foreign Application Priority Data

May 7, 2020 (DE) ..... 10 2020 112 367.1

(51) Int. Cl.
*F02P 3/04* (2006.01)
*H01T 13/04* (2006.01)

(52) U.S. Cl.
CPC ..... *F02P 3/0407* (2013.01); *H01T 13/04* (2013.01)

(58) Field of Classification Search
CPC ..... F02P 3/0407; H01T 13/04; H01T 13/05; H01T 13/08; H01T 13/10; H01T 13/12
See application file for complete search history.

(56) References Cited

U.S. PATENT DOCUMENTS 5,682,865 A * 11/1997 Maekawa ..... F02P 3/02 123/169 PA
6,192,873 B1 * 2/2001 Adachi ..... H01F 38/12 123/169 PA
6,247,943 B1 * 6/2001 Moga ..... H01R 13/53 439/125

(Continued)

FOREIGN PATENT DOCUMENTS

DE 10352122 5/2004
DE 102009035897 2/2011
DE 102010051371 5/2012

OTHER PUBLICATIONS

Office Action dated Jan. 13, 2021 issued in German Patent Application No. 102020112367.1.

*Primary Examiner* — George C Jin
(74) *Attorney, Agent, or Firm* — Cozen O'Connor

(57) ABSTRACT

A contacting device of a voltage transmission device of an ignition device of a large engine, whose cylinders have piston diameters of at least 140 mm having a first spring portion for the electrical contacting of a cable contacting piece of the voltage transmission device and a second spring portion for the electrical contacting of a spark plug connection of a spark-plug of the ignition device. The second spring portion tapers in a direction of its end, which comes to lie against the spark-plug connector of the spark-plug. The spark-plug connector of the spark-plug interacting with the contacting device includes a trough into which the contacting device can be introduced with a spring portion.

13 Claims, 1 Drawing Sheet

(56) References Cited

U.S. PATENT DOCUMENTS

| | | | | |
|---|---|---|---|---|
| 6,491,531 | B1 * | 12/2002 | Reinmueller | H01T 13/04 439/125 |
| 6,668,810 | B1 * | 12/2003 | St. John | F02P 3/02 336/107 |
| 7,455,536 | B2 * | 11/2008 | Virchow | H01R 24/20 439/125 |
| 2001/0045800 | A1 * | 11/2001 | Hamada | H01R 13/2421 313/625 |
| 2008/0024258 | A1 * | 1/2008 | Nakao | H01F 38/12 336/107 |
| 2011/0086528 | A1 * | 4/2011 | Schneider | H01R 13/193 439/125 |
| 2012/0186568 | A1 * | 7/2012 | Steinberger | H01T 13/40 123/634 |
| 2012/0273332 | A1 * | 11/2012 | Rust | H01R 13/187 200/276 |
| 2013/0155570 | A1 * | 6/2013 | Stifel | H01T 13/50 361/263 |
| 2013/0298887 | A1 * | 11/2013 | Lewandowski | H01T 13/05 123/647 |
| 2019/0226442 | A1 * | 7/2019 | Mayer | F02P 13/00 |
| 2020/0312544 | A1 * | 10/2020 | Tsunenaga | H01T 13/44 |
| 2021/0087998 | A1 * | 3/2021 | Dirumdam | F02P 3/02 |

* cited by examiner

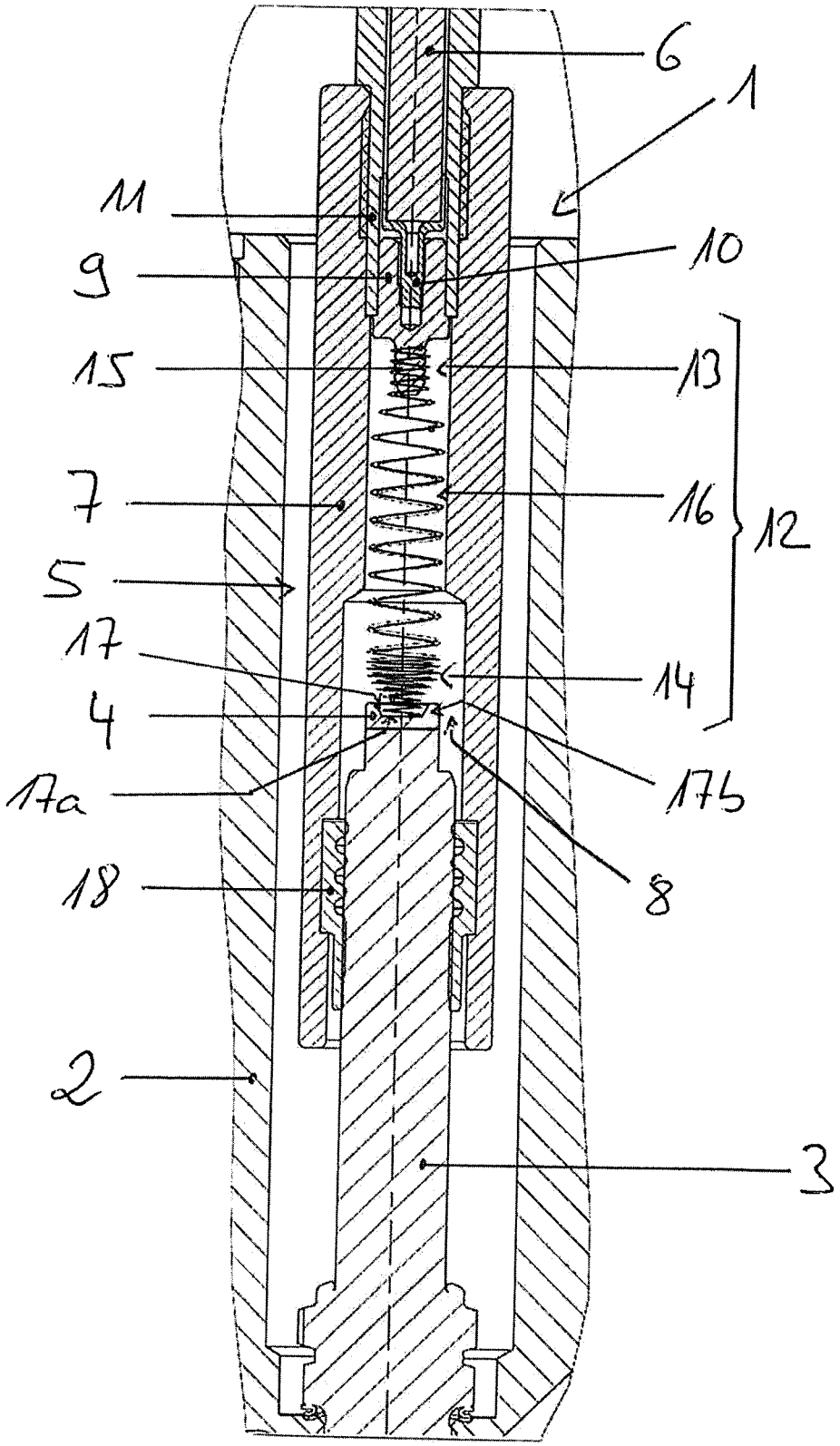
6
1
11
10
9
15
13
7
16
12
5
17
14
4
17a
17b
8
18
2
3

CONTACTING DEVICE OF A VOLTAGE TRANSMISSION DEVICE OF AN IGNITION DEVICE OF A LARGE ENGINE, SPARK-PLUG, IGNITION DEVICE AND LARGE ENGINE

BACKGROUND OF INVENTION

1. Field of the Invention

The disclosure relates to a contacting device of a voltage transmission device of an ignition device of a large engine. The disclosure, furthermore, relates to a spark-plug and to an ignition device of a large engine and to a large engine.

The disclosure present here relates to so-called large engines or large internal combustion engines, the cylinders of which have piston diameters of at least 140 mm or more, in particular at least 175 mm. Such large internal combustion engines are for example engines of ships or power plant engines.

2. Description of Related Art

Large engines, which operate according to the Otto principle, require an ignition device for igniting the fuel in the cylinders. Such ignition devices comprise spark-plugs that have to be supplied with electric voltage. To this end, a voltage transmission device, which is also referred to as high-voltage extension, acts on the spark-plug.

In the case of large engines with ignition devices known from practice, the voltage transmission device comprises an insulator, a cable contacting piece for electrical cables, and an electrically conductive contacting device, which is positioned between the cable contacting piece and an electrical spark-plug connector of the spark-plug and electrically conductively contacts both the spark-plug connector of the spark-plug and also the cable contacting piece. The contacting device serves for transmitting ignition voltage in the direction of the spark-plug.

The contacting device of large engines known from practice is designed so that an end of the contacting device facing the spark-plug connector of the spark-plug encloses the spark-plug connector radially outside.

In the case of large engines known from practice there is the problem that the contacting device of the ignition device has a tendency of slipping or tilting as a result of which the contacting device can slip on the spark-plug connector and come to lie against the insulator. This affects the function of the ignition device negatively.

SUMMARY OF THE INVENTION

One aspect of the present invention is a new type of contacting device of a voltage transmission device of an ignition device of a large engine, a spark-plug, an ignition device of a large engine having such a contacting device and spark-plug, and a large engine having such an ignition device.

According to one aspect of the invention, the second spring portion tapers in the direction of its end which comes to lie against the spark-plug connector of the spark-plug. The second spring portion provides a centring function for the contacting device on the spark-plug.

The tapering second spring portion of the contacting device, which with its end comes to lie against the spark-plug connector of the spark-plug, provides the centring function for the contacting device and thus prevents a tilting or slipping of the spring. It is avoided that the contacting device on the spark-plug connector slips and comes to lie against the insulator. By way of this, the function of the ignition device is improved.

Between the first spring portion and the second spring portion a third spring portion is formed that provides a preloading function and a tolerance compensation function in the longitudinal direction of the contacting device. The third spring portion preferentially has a greater axial length and a greater spring coil pitch than the second spring portion. A winding diameter of the second spring portion tapers, emanating from the third spring portion, in the direction of its free end. Such a contacting device is particularly preferred. The second spring portion provides the centring function. The third spring portion provides the preloading function and the tolerance compensation function in the longitudinal direction of the contacting device. By way of this, ignition energy can be particularly advantageously transmitted in the direction of the spark-plug.

BRIEF DESCRIPTION OF THE DRAWINGS

Preferred further developments of the invention are obtained from the subclaims and the following description. Exemplary embodiments of the invention are explained in more detail by way of the drawing without being restricted to this. There it shows:

The FIGURE is an extract of an ignition device of a large engine having a contacting device of a voltage transmission device of the ignition device.

DETAILED DESCRIPTION OF THE PRESENTLY PREFERRED EMBODIMENTS

The disclosure relates to an area of so-called large engines or large internal combustion engines, the cylinders of which have piston diameters of at least 140 mm or more, in particular of at least 175 mm. Such large engines are for example engines of ships or power plant engines. With the invention, these are embodied as Otto engines or also as dual fuel engines that can be operated in the Otto operating mode.

The FIGURE shows an extract from a large engine in a region of an ignition device 1 according to one aspect of the invention, which is received in a cylinder head 2 or a prechamber of the large engine.

The ignition device 1 comprises a spark-plug 3 which serves for igniting the fuel. The spark-plug 3 comprises an electrical spark-plug connector 4.

Furthermore, the ignition device 1 comprises a voltage transmission device 5 which is also referred to as high-voltage extension. The voltage transmission device 5 serves for transmitting electric energy or transmitting an electric ignition voltage emanating from an electrical voltage transmission cable 6 in the direction of the spark-plug 3, namely the spark-plug connector 4 of the same.

The voltage transmission device 5 comprises an insulator 7 with a central recess 8, into which the spark-plug 3 with the spark-plug connector 4 projects. The voltage transmission device 5, furthermore, comprises a cable contacting piece 9 that serves for the electrical contacting of the cable 6, namely of a cable terminal 10 arranged at the end of the cable 6. By way of a crimping device 11, the cable contacting piece 9, and the cable terminal 10 can be crimped together.

The voltage transmission device 5, furthermore, comprises an electrically conductive contacting device 12, which is preferentially formed as a spring 12. In the following FIGURE description, the electrically conductive contacting device 12 is referred to as spring.

The electrically conductive spring 12 contacts with a first spring portion 13 the cable contacting piece 9 and with a second spring portion 14 located opposite, the spark-plug 3, namely the spark-plug connector 4 of the same.

From the FIGURE it is evident that the first spring portion 13 is mounted on a threaded projection 15 of the cable contacting piece 9, wherein the second spring portion 14 located opposite electrically contacts the spark-plug connector 4 of the spark-plug 3 with a free end.

The second spring portion 14 of the spring 12 is formed in such a manner that the same tapers in the direction of its free end, which comes to lie against the spark-plug connector 4 of the spark-plug 3. There, a winding diameter of the second spring portion 14 tapers in the direction of its free end, with which the spring 12 and thus the second spring portion 14 comes to lie against the spark-plug connector 4 of the spark-plug 3. This second spring portion 14 provides a centring function for the spring 12 and ensures that the spring 12 does not touch the insulator 7 and does not slip on the spark-plug 4.

Between the first spring portion 13 and the second spring portion 14, the spring 12 comprises a third spring portion 16 that provides a preloading function and a tolerance compensation function in the longitudinal direction of the spring 12. Thus, while the first spring portion 13 serves for fastening the spring 12 to the threaded projection 15 of the cable contacting piece 9, the second spring portion 14 serves for the electrical contacting of the spark-plug connector 4 and the centering of the spring 12. The third spring portion 16 provides tolerance compensation function and preloading function.

While the first spring portion 13 and the second spring portion 16 are each wound cylindrically, the second spring portion 14 tapers in the manner of a truncated cone. The third spring portion 16 has a greater axial length and a greater spring coil pitch than the second spring portion 14. A distance between the individual windings of the second spring portion 14 is significantly smaller than a distance of the windings of the third spring portion 16 and of the first spring portion 13.

On the spark-plug connector 4 of the spark-plug 3 a trough 17 is formed, into which the second spring portion 14 projects with its free end. The second spring portion 14 contacts the spark-plug connector 4 in the region of a trough bottom 17*a* of the trough 17. Here, the trough bottom 17*a* is embodied flat and smooth.

From the trough bottom 17*a*, a trough rim 17*b* extends in the direction of the spring 12. The trough rim 17*b* has a height that corresponds at least to the spring wire thickness of the spring 12 in a region of the second spring portion 14. In particular, the height of the trough rim 17 corresponds at least to two times the spring wire thickness of the spring 12 in the second spring portion 14.

Preferentially, the spring wire thickness of the spring 12 is identical in all spring portions 13, 14 and 16. The individual spring portions 13, 14, and 16 however can also have different spring wire thicknesses.

By way of the second spring portion 14 of the spring 12 tapering in the direction of the free end combined with the trough 17 of the spark-plug connector 4, a particularly advantageous centering of the spring 12 on the spark-plug 3 can take place. There, the trough rim 17*b* of the trough 17 is conically contoured, in particular in the manner of a truncated cone, with a tapering direction that corresponds to the tapering direction of the second spring portion 14 of the spring 12. Because of the fact that the trough rim 17*b* surrounds the spring 12 on the second spring portion 14 at least in regions, an advantageous shielding of the end of the second spring portion 14 relative to a radiation of an inhomogeneous electromagnetic field at the end of the second spring portion 14 can be ensured.

The ignition energy, which is transmitted from the voltage transmission device 5 in the direction of the spark-plug 3, is preferentially provided capacitively.

The FIGURE furthermore, shows a seal 18 positioned between the insulator 7 of the voltage transmission device 5 and a portion of the spark-plug 3. The seal 18 is part of the voltage transmission device 5 referred to as high-voltage extension.

A large engine, comprising the ignition device according to the invention having the spring according to one aspect of the invention is preferentially embodied as gas engine and comprises cylinders with a piston diameter of at least 140 mm or more, in particular of at least 175 mm.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A contacting device of a voltage transmission device of an ignition device of a large engine, cylinders of the large engine have piston diameters of at least 140 mm, comprising:

a first spring portion that electrically contacts a cable contacting piece of the voltage transmission device; and a second spring portion that electrically contacts a spark-plug connector of a spark-plug of the ignition device;

a third spring portion formed between the first spring portion and the second spring portion the third spring portion having a plurality of adjacent coils each tapering in diameter from the first spring portion to a maximum diameter of the contacting device, wherein the second spring portion tapers in a free end direction that lays against the spark-plug connector of the spark-plug, wherein respective windings of each of the first spring portion, the second spring portion, and the third spring portion are spaced apart from respective adjacent windings, and wherein only the first, second, and third spring portions provide an only electrical connection between the cable contacting piece of the voltage transmission device and the spark-plug connector.

2. The contacting device according to claim 1, wherein the second spring portion is configured to center the contacting device on the spark-plug.

3. The contacting device according to claim 1, wherein the third spring portion provides a preloading and a tolerance compensation in a longitudinal direction of the contacting device.

4. The contacting device according to claim 3, wherein the third spring portion has a greater axial length and a greater spring coil pitch than the second spring portion.

5. The contacting device according to claim 3, wherein a winding diameter the second spring portion, emanating from the third spring portion, tapers in the free end direction.

6. The contacting device according to claim 4, wherein a winding diameter the second spring portion, emanating from the third spring portion, tapers in the free end direction.

7. The contacting device according to claim 1, wherein the second spring portion tapers gradually from the end direction that lays against the spark-plug connector to a maximum coil diameter that is substantially equal to an end coil diameter of the third spring portion adjacent to the second spring portion.

8. An ignition device of a large engine, whose cylinders have piston diameters of at least 140 mm, comprising:

a spark-plug, that comprises an electrical spark-plug connector;

a voltage transmission device that supplies the spark-plug with an electric ignition voltage, the voltage transmission device comprises:

an insulator;

a cable contacting piece for an electrical cable; and an electrically conductive contacting device, which extends between the cable contacting piece and the electrical spark-plug connector of the spark-plug that comprises:

a first spring portion that electrically contacts a cable contacting piece of the voltage transmission device; and a second spring portion that electrically contacts a spark-plug connector of a spark-plug of the ignition device;

a third spring portion formed between the first spring portion and the second spring portion the third spring portion having a plurality of adjacent coils each tapering in diameter from the first spring portion to a maximum diameter of the contacting device, wherein the second spring portion tapers in an end direction that lays against the spark-plug connector of the spark-plug;

wherein the electrical spark-plug connector of the spark-plug comprises a trough into which the second spring portion projects, wherein respective windings of each of the first spring portion, the second spring portion, and the third spring portion are spaced apart from respective adjacent windings, and wherein only the first, second, and third spring portions provide an electrical connection between the cable contacting piece of the voltage transmission device and the spark-plug connector.

9. The ignition device according to claim 8, wherein the trough comprises a trough bottom and a trough rim, wherein the trough rim has a height that corresponds at least to a spring wire thickness of the contacting device.

10. The ignition device according to claim 9, wherein the trough rim has a height that corresponds to at least two times the spring wire thickness of the contacting device.

11. A large engine, whose cylinders have piston diameters of at least 140 mm, and which in a region of each cylinder comprises:

an ignition device, comprising:

a spark-plug, that comprises an electrical spark-plug connector;

a voltage transmission device that supplies the spark-plug with an electric ignition voltage, the voltage transmission device comprises:

an insulator;

a cable contacting piece for an electrical cable; and an electrically conductive contacting device, which extends between the cable contacting piece and the electrical spark-plug connector of the spark-plug that comprises:

a first spring portion that electrically contacts a cable contacting piece of the voltage transmission device, wherein the adjacent coils of the first spring portion are radially spaced from the insulator; and a second spring portion that electrically contacts a spark-plug connector of a spark-plug of the ignition device, wherein the adjacent coils of the second spring portion are radially spaced from the insulator;

a third spring portion formed between the first spring portion and the second spring portion the third spring portion having a plurality of adjacent coils each tapering in diameter from the first spring portion to a maximum diameter of the contacting device, wherein a portion the adjacent coils of the third spring portion contact the insulator, wherein the second spring portion tapers in an end direction that lays against the spark-plug connector of the spark-plug;

wherein the electrical spark-plug connector of the spark-plug comprises a trough into which the second spring portion projects, wherein respective windings of each of the first spring portion, the second spring portion, and the third spring portion are spaced apart from respective adjacent windings, and wherein only the first, second, and third spring portions provide an electrical connection between the cable contacting piece of the voltage transmission device and the spark-plug connector.

12. The large engine, of claim 11, wherein the same is a gas engine.

13. The large engine, of claim 11, wherein the cylinders have piston diameters of at least 175 mm.

* * * * *